US010641445B2

(12) United States Patent
Sburlan

(10) Patent No.: US 10,641,445 B2
(45) Date of Patent: May 5, 2020

(54) ILLUMINATION SYSTEM

(71) Applicant: Tudor N Sburlan, Baldwin Park, CA (US)

(72) Inventor: Tudor N Sburlan, Baldwin Park, CA (US)

( * ) Notice: Subject to any disclaimer, the term of this patent is extended or adjusted under 35 U.S.C. 154(b) by 0 days.

(21) Appl. No.: 16/212,097

(22) Filed: Dec. 6, 2018

(65) Prior Publication Data

US 2019/0376655 A1 Dec. 12, 2019

Related U.S. Application Data

(60) Provisional application No. 62/595,430, filed on Dec. 6, 2017.

(51) Int. Cl.

| | |
|---|---|
| ***A47F 11/10*** | (2006.01) |
| ***F21S 4/28*** | (2016.01) |
| ***A47F 5/00*** | (2006.01) |
| ***A47G 23/02*** | (2006.01) |
| *F21W 131/405* | (2006.01) |

(52) U.S. Cl.

CPC ..... *F21S 4/28* (2016.01); *A47F 5/0068* (2013.01); *A47G 23/0266* (2013.01); *A47B 2220/0077* (2013.01); *A47G 2200/08* (2013.01); *F21W 2131/405* (2013.01)

(58) Field of Classification Search

None

See application file for complete search history.

(56) References Cited

U.S. PATENT DOCUMENTS

| | | | | |
|---|---|---|---|---|
| 8,978,903 | B2 * | 3/2015 | Hardy | A47F 1/126 211/126.12 |
| 9,814,325 | B1 * | 11/2017 | Mendre | A47F 7/28 |
| 9,844,279 | B2 * | 12/2017 | Cinici | A47F 3/001 |
| 2008/0277361 | A1 * | 11/2008 | Primiano | A47F 3/001 211/49.1 |

* cited by examiner

*Primary Examiner* — Vip Patel

(74) *Attorney, Agent, or Firm* — Cohen IP Law Group, PC; Michael N. Cohen

(57) ABSTRACT

An illumination system is disclosed. The illumination system may include a base that may support a lighting assembly. The base and the lighting assembly may be configured within a beverage container display unit to illuminate the beverages within the unit. The base and the lighting assembly may be located below the beverage containers within the unit to illuminate the containers from below.

20 Claims, 9 Drawing Sheets

200
222
224
229
230
232
234
236
218
220

ILLUMINATION SYSTEM

CROSS-REFERENCE TO RELATED APPLICATIONS

This application claims the benefit of U.S. Provisional Patent Application No. 62/595,430, filed Nov. 6, 2007, the entire contents of which is hereby fully incorporated herein by reference for all purposes.

COPYRIGHT STATEMENT

This patent document contains material subject to copyright protection. The copyright owner has no objection to the reproduction of this patent document or any related materials in the files of the United States Patent and Trademark Office, but otherwise reserves all copyrights whatsoever.

FIELD OF THE INVENTION

The current invention generally relates to an illumination system. In particular, the invention relates to a system that provides illumination to beverage containers within a display or rack.

BACKGROUND OF THE INVENTION

The retail beverage industry is approaching a trillion dollar industry, with thousands of different brands and flavors of soft drinks, bottled water, juices, energy drinks and other types of beverages vying for retail shelf space and customer attention.

Currently, most grocery, liquor and/or convenience stores display single serving and/or multi-serving cold beverages in refrigerated displays that may contain shelves lined with hundreds of different types and brands of drink options.

For example, when a customer may be interested in purchasing bottled water, they may find up to ten or more different options to choose from within the refrigerated display case. Studies show that customers may make impulse purchases based on the marketing attributes of the product. For example, a customer may make a purchase decision based on the label, the brand, the shape of bottle, the location of bottle within display, whether or not the item is on sale or not, or other attributes. However, the marketplace is becoming saturated and these marketing attributes are becoming less and less effective making it difficult for brands and products to stand out.

Accordingly, there is a need for a system and method that may present beverages within a display in a way that may capture the customers' attention. In addition, there is a need for a system and method that may to bring sale items or other promotional items to the attention of the customers.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
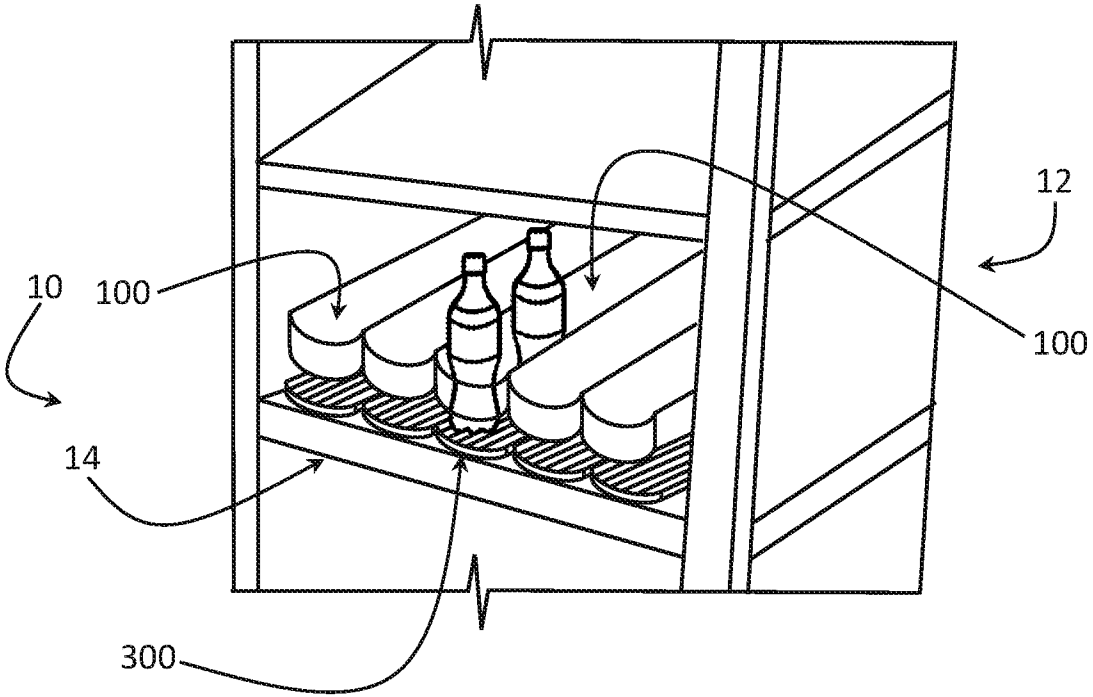
FIG. 1 is a view of an illumination system according to exemplary embodiments hereof.

The following detailed description is not intended to limit the current invention. Alternate embodiments and variations of the subject matter described herein will be apparent to those skilled in the art.

The illumination system 10 of the current invention and the benefits it may provide are now described with reference to the figures. Where the same or similar components appear in more than one figure, they are identified by the same or similar reference numerals.

In general, the illumination system 10 may include a beverage display unit that may include at least one shelf and/or at least one channel configured within the unit, and an illumination assembly (e.g., an illuminated strip) generally configured with the at least one shelf and/or the at least one channel. The shelf and/or the channel may support beverage containers within the display, and the illumination assembly (also referred to as a lighting assembly, an illumination device, a lighting device or similar) may be generally positioned below the beverage containers so that it may illuminate the containers from below. The illumination assembly may include individual illumination components (e.g. LEDs) that may be positioned periodically along its length. The illumination components may each emit light upward into the bottoms of the beverage containers supported by the shelf and/or channel such that the different beverage containers may be illuminated by the different illumination components.

Before describing illumination system 10 in detail, this specification will briefly describe the general composition, construction or make-up of beverage containers and how they may be displayed for purchase in retail or as an aesthetic effect in bars or restaurants. As is widely known in the art, beverage containers such as single serving or multi-serving sodas, bottled water, sports drinks, juices, teas, energy drinks, vitamin drinks, or other types of drinks may be packaged in transparent, lightly colored/tinted or opaque glass or plastic bottles. As shown in FIG. 1, the bottles may be displayed in retail storefronts (e.g. in grocery stores, supermarkets, liquor stores, convenience stores, big box stores, discount stores and in other types of retail stores) in refrigerated or non-refrigerated display units 12 that may include a multitude of shelves 14, racks and/or channels 100 that may hold or generally contain the beverage containers. In this way, the shelves 14 and/or channels 100 may support rows of side-by-side beverage containers that may generally run from the front of the display unit to the back.

In some embodiments, the displays 12 may include multiple shelves 14 at different heights that may each be configured with multiple channels 100 to hold rows or columns of beverage containers. In this scenario, the channels 100 may be supported by the shelves 14 and the beverage containers may be supported within the channels 100. The channels 100 and/or the beverage containers may preferably be generally oriented perpendicular to the front doors of the display units 12. Different beverages may be included in different channels 100 or on different shelves 14 such that when a customer may open the front door of the display 12, he/she may have access to a variety of different beverage containers to choose from.

In other embodiments the beverages may rest on the shelves 14 in rows or columns. In this scenario, the shelves 14 may or may not include channels 100. In other embodiments, the display unit 12 may include rows of channels 100 that may represent shelves 14. Other configurations of display units 12, shelves 14 and channels 100 are also contemplated.

In some embodiments, the channels 100 may be configured with the shelves 14 such that the channels 100 may be removable and/or interchanged. In some embodiments, the channels 100 may be integrated into the shelves 14 such that the channels 100 may not be removable. In either case, the shelves 14 may include brackets or other types of structures that may receive, secure and generally support the channels 100.

In some embodiments, the shelves 14 may not necessarily include channels and the beverage containers may simply rest on the shelves 14, preferably in rows or columns.

Note that the shelves 14 and/or the channels 100 may be formed as individual units and/or may be formed together as multi-shelf and/or multi-channel units. The shelves 14 and/or the channels 100 may comprise plastic, metal, rubber, other types of materials and any combination thereof.

Figure 5A:
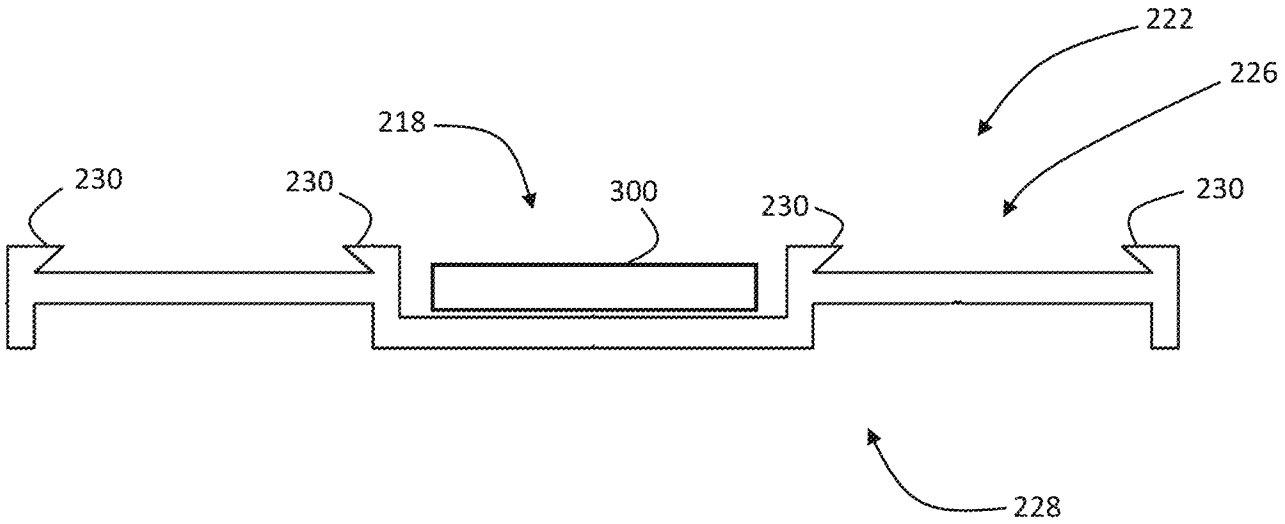
FIG. 5A is front view of a lower base section according to exemplary embodiments hereof.
Figures 5B, 5C, 5D, 5E, 5F, 5G, 5H, 5I:
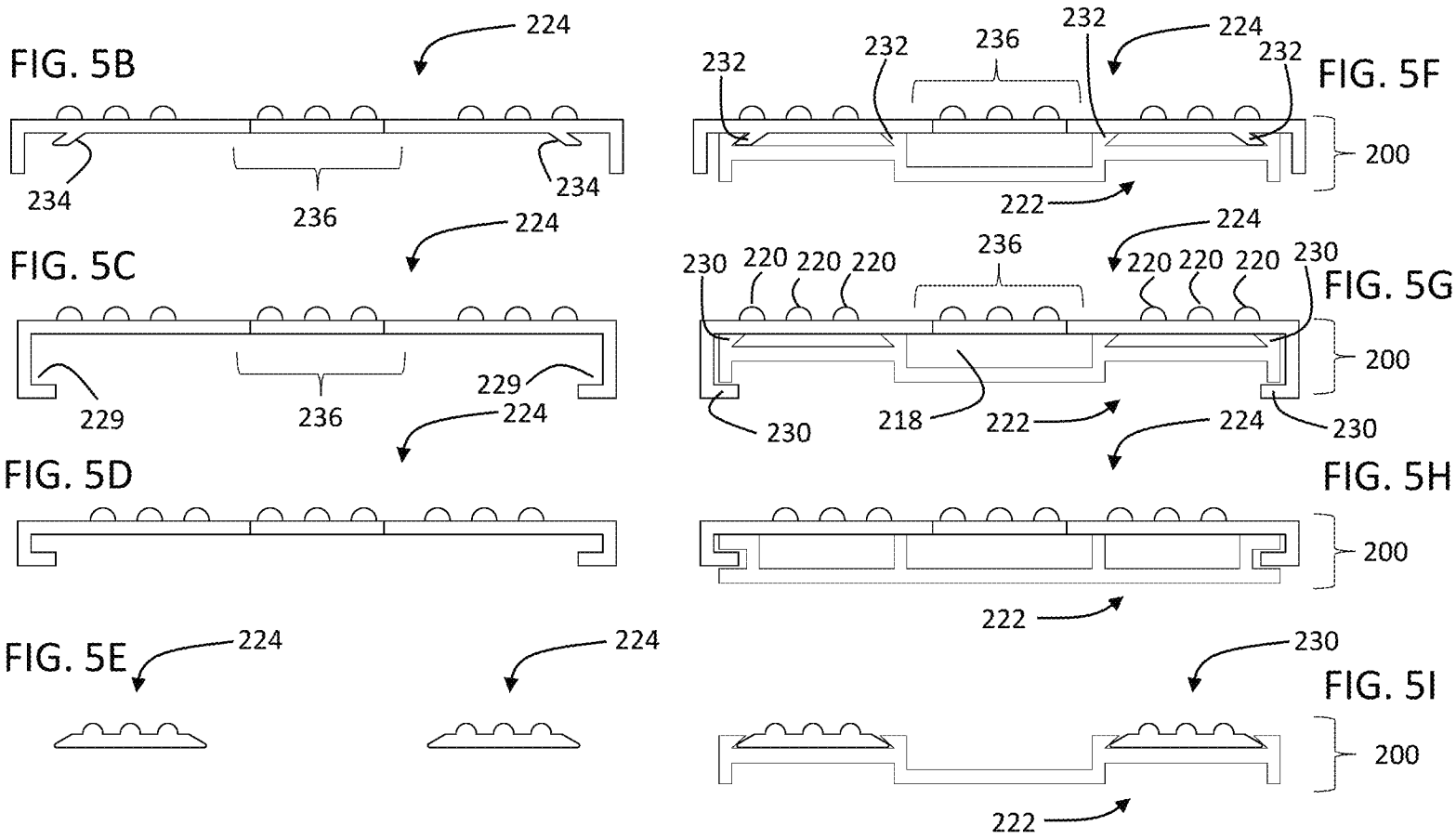
FIGS. 5B-5E are front views of upper base sections according to exemplary embodiments hereof.
FIGS. 5F-5I are front views of lower base sections configured with upper base sections to form bases according to exemplary embodiments hereof.
Figure 6:
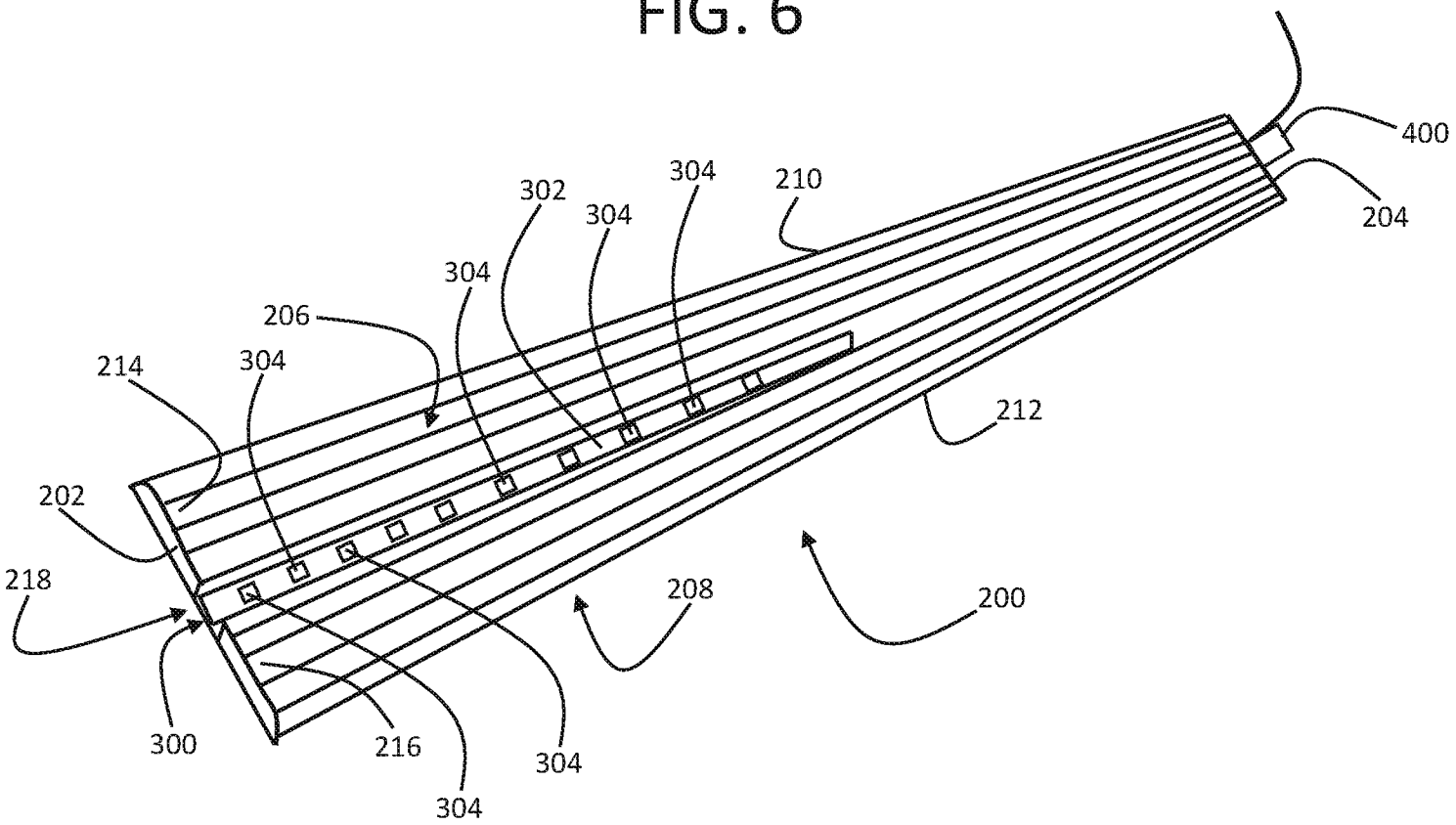
FIG. 6 is a view of a lighting assembly configured with a base according to exemplary embodiments hereof.
Figure 7:
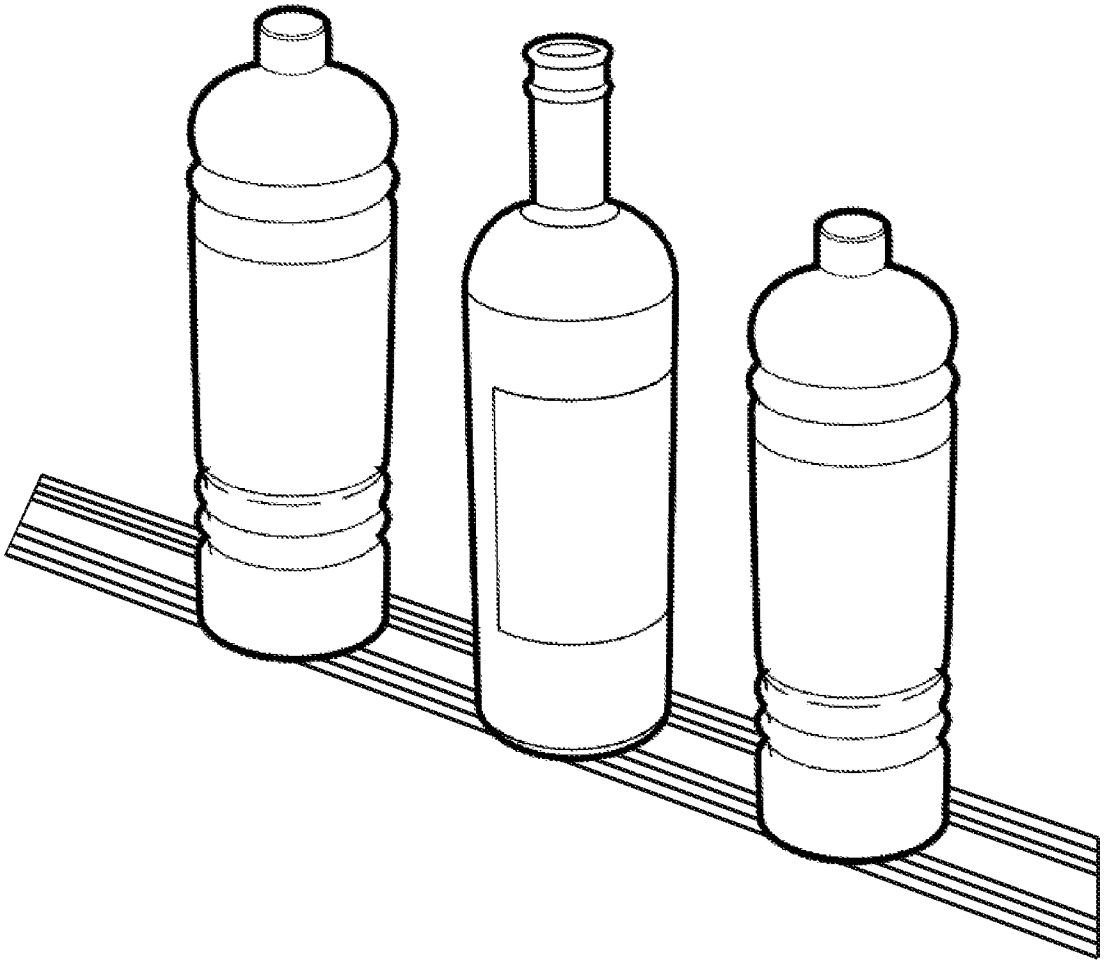
FIG. 7 is a perspective view of an illuminated lighting assembly configured with beverage containers according to exemplary embodiments hereof.

In some exemplary embodiments hereof, the system 10 may include a display unit 12 and a lighting assembly 300. In some exemplary embodiments hereof, the system 10 may include a lighting assembly 300 that may be configured with an existing display unit 12 (e.g., an existing display unit 12 may be retrofitted with the lighting assembly 300). This is shown in FIGS. 5 and 6. In either case, the system 10 may or may not include shelves 14 and/or channels 100. Other embodiments and combinations thereof are also contemplated.

It is understood by a person of ordinary skill in the art, upon reading this specification, that the system 10 may include or may be configured with a display unit that may support beverage containers in any way, and that the scope of the system 10 is not limited by the way in which the display unit may support the beverage containers. It is also understood that the shelves may be configured with the channels in any way, or not configured with channels at all, and that the scope of the system 10 is not limited by the way in which the shelves may or may not be configured with channels. It is also understood that the lighting assemblies 300 may be configured with the display unit 12, the shelves 14 and/or the channels 100 in any way, and that the scope of the system 10 is not limited by the way in which the lighting assembly 300 may be configured with the display 12, the shelves 14, the channels 100 or any combination thereof.

In practice, each shelf 14 and/or channel 100 within each display 12 may include up to ten or more units of each beverage container. In this way, the side-by-side beverage containers may form a matrix of beverage containers. Also, the front of the shelves 14 and/or the channels 100 to be set slightly lower than the back of the shelves 14 and/or the channels 100 within the display unit 10 such that as beverage containers may be removed from the front by customers, the row of beverage containers held within the particular channel 100 may slide forward to become available at the front of the display 12. That is, there may be a slight declined angle from the back of the channels 100 and/or shelves 14 to the front of the channels 100 and/or shelves 14 that may cause the beverage containers to slide to the front of the channels 100 and/or shelves 14.

Each channel 100 may include a width that may be wide enough to receive and generally hold a standard beverage container within the channel 100 (single serving and/or multi-serving) but preferably not too wide as to leave a large gap on either side of the beverage container within the channel 100. This may result in the rows of beverage containers within side-by-side channels 100 to be in relatively close proximity to each other.

In bars and restaurant environments, bottles of liquor or other types of beverage containers may be displayed on shelves behind the bar in order to show the customers their selection to choose from. The bottles may be displayed in rows along the shelves and each row may be one bottle deep, or multiple bottles deep.

Figure 2:
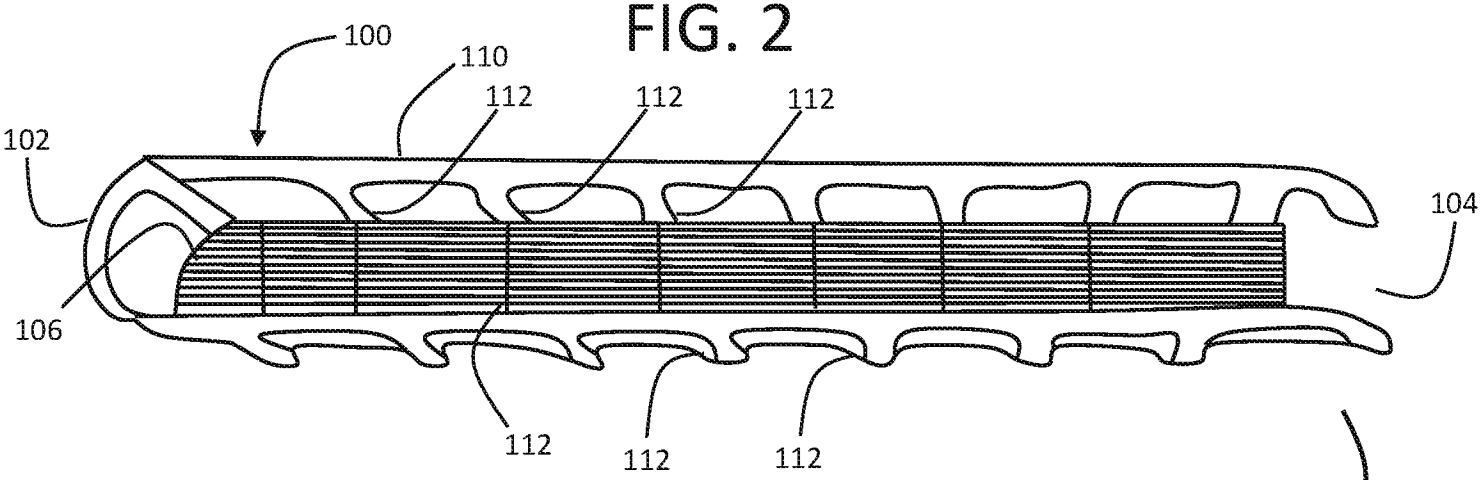
FIG. 2 is a perspective view of a channel according to exemplary embodiments hereof.

In one exemplary embodiment hereof, FIG. 2 depicts a beverage container display channel 100 that has been removed from the display case 12 for demonstration. The display channel 100 may generally include a front 102, a back 104, a bottom 106, a left side 108 and a right side 110. However, it is understood that a channel 100 may not necessarily include all of these elements all the time. For example, if multiple channels 100 are formed together (e.g., side by side), each channel 100 may not necessarily include a left 108 and a right side 110. In addition, the channels 100 may not include a bottom 106, but instead, the top surface of the shelf 14 that the channel 100 may be configured with may instead form the bottom 106 of the channel 100.

The width of the channel 100 may be defined by the distance between left side 108 and right side 110 and may be chosen to accommodate and generally receive standard sized beverage containers (either single serving and/or multi-serving). The sides 108, 110 may be of adequate height to support the beverage containers it may hold, and may be solid or may include cutouts to reduce the weight and amount of materials used to manufacture channel 100. The height of sides 108, 110 may also vary along the channel 100. It is also contemplated that the sides 108, 110 may or may not include upright side walls. The channels 100 may comprise metal, plastic, rubber, other types of materials and any combination thereof.

In some embodiments, the bottom 106 of channel 100 may be removable so that it may be periodically cleaned and/or replaced if it may happen to become damaged. This may also allow one version of the bottom 106 to be replaced by another version of the bottom 106 (e.g., by an illuminated bottom). Alternatively, the bottom 106 may not be removable from channel 100. In yet another alternative, the channel 100 may not include a bottom 106 such that the top of the shelving 14 that the channel 100 may be configured with may provide and effectively act as the bottom of the channel 100.

In one exemplary embodiment hereof, the lighting assembly 300 (FIGS. 4, 5A and 6) may be configured with the shelves 14 and/or the channels 100 of the display 12, and may illuminate at least a portion of the beverage containers that may be supported within the display 12. In one exemplary embodiment hereof, the system 10 may include an illumination base 200 that may support the lighting assembly 300. The illumination base 200 will be described next and the lighting assembly 300 thereafter.

The Illumination Base

Figure 3A:
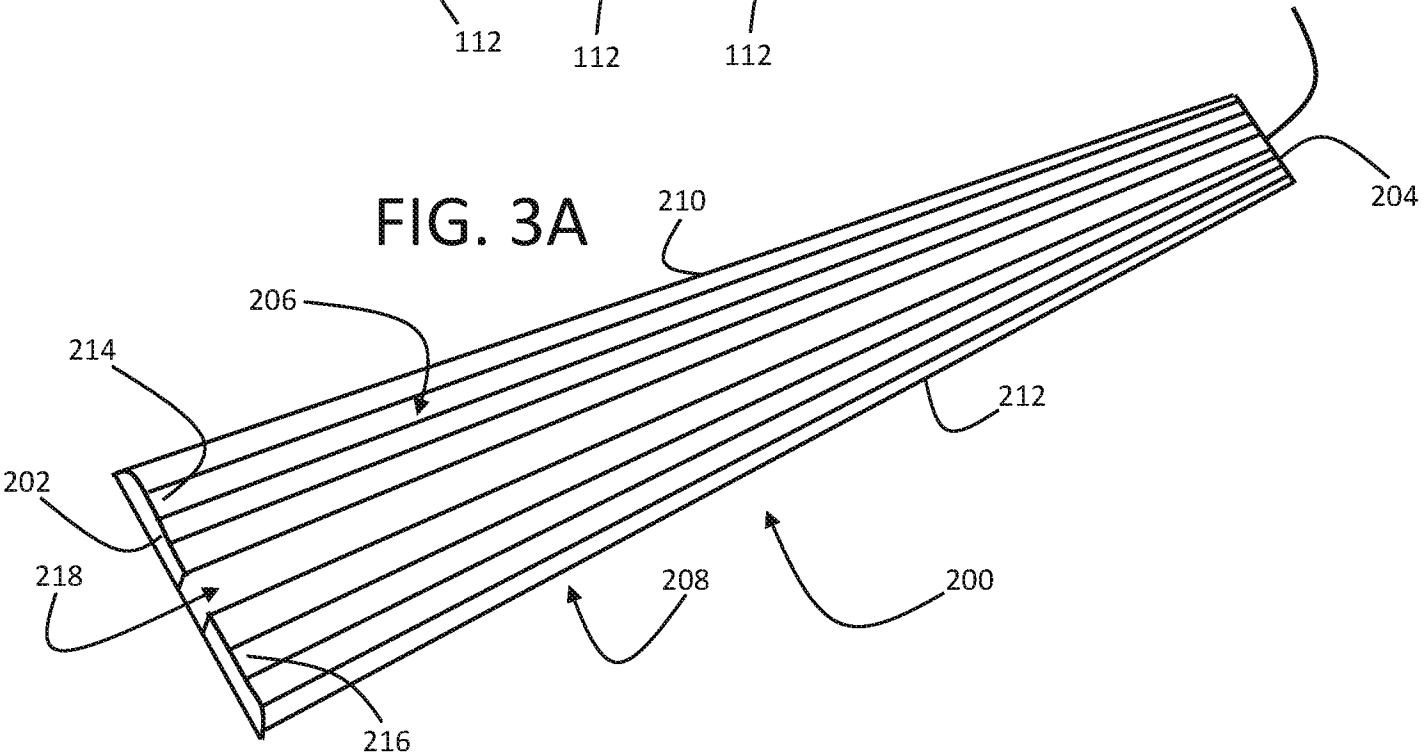
FIGS. 3A-3C are perspective views of bases according to exemplary embodiments hereof.

In one exemplary embodiment hereof, an illuminated base 200 may support the lighting assembly 300. In one exemplary implementation, the illumination base 200 may replace the removable bottom 106 in the display channel 100. That is, the removable bottom 106 may be removed from the channel 100, and the illuminated base 200 may be installed within the channel 100 in its place. For the purposes of this specification, the illuminated base 200 of this embodiment may be referred to as illuminated base 200-1. As shown in FIG. 3A, the illuminated base 200-1 may include a front 202, a back 204, a top 206, a bottom 208, a left side 210 and a right side 212. Base 200-1 may be of similar size and shape as removable bottom 106, and may include any other elements or characteristics that may be required for illuminated base 200-1 to replace removable bottom 106 and to be configured within channel 100 as the bottom of channel 100. Base 200-1 may comprise metal (e.g. aluminum), plastic, rubber, other types of materials and any combination thereof.

In one exemplary embodiment, the illuminated base 200-1 may include a width that may be received within channel 100 so that illuminated base 200-1 may generally form the bottom of channel 100, and a length that may generally extend from the front 102 of channel 100 to the back 104 of channel 100 or a portion thereof. It may be preferable that regardless of the architecture of channel 100, illuminated base 200-1 may be configured within channel 100 to generally replace removable bottom 106 as the bottom of channel 100. For instance, illuminated base 200-1 may be configured within channel 100 to be adequately supported by lateral support structures 112 (best seen in FIG. 2) or by a bottom support base, depending on what support structures channel 100 may include. In any event, it may be preferable that illuminated base 200-1 be configured as the bottom of channel 100 regardless of the architecture of channel 100, whether the specific architecture is described above or not.

In practice, by forming the bottom of channel 100, the top 206 of illuminated base 200-1 may receive and support various beverage containers that may be placed within channel 100. It may be preferable that base 200-1 be generally held secure within channel 100 so that it may not slide or generally move around within the channel 100.

In the case where the bottom 106 of channel 100 may generally not be removable, or if it may be desirable to not remove bottom 106 even if it were, illuminated base 200 may be configured to rest upon bottom 106 within channel 100. In this way, illuminated base 200 may effectively form the top surface of the bottom of channel 100. That is, the bottom of channel 100 may include bottom 106 with base 200 generally resting upon its top surface. For the purposes of this specification, the illuminated base 200 of this embodiment may be referred to as illumination base 200-2.

Figure 3B:
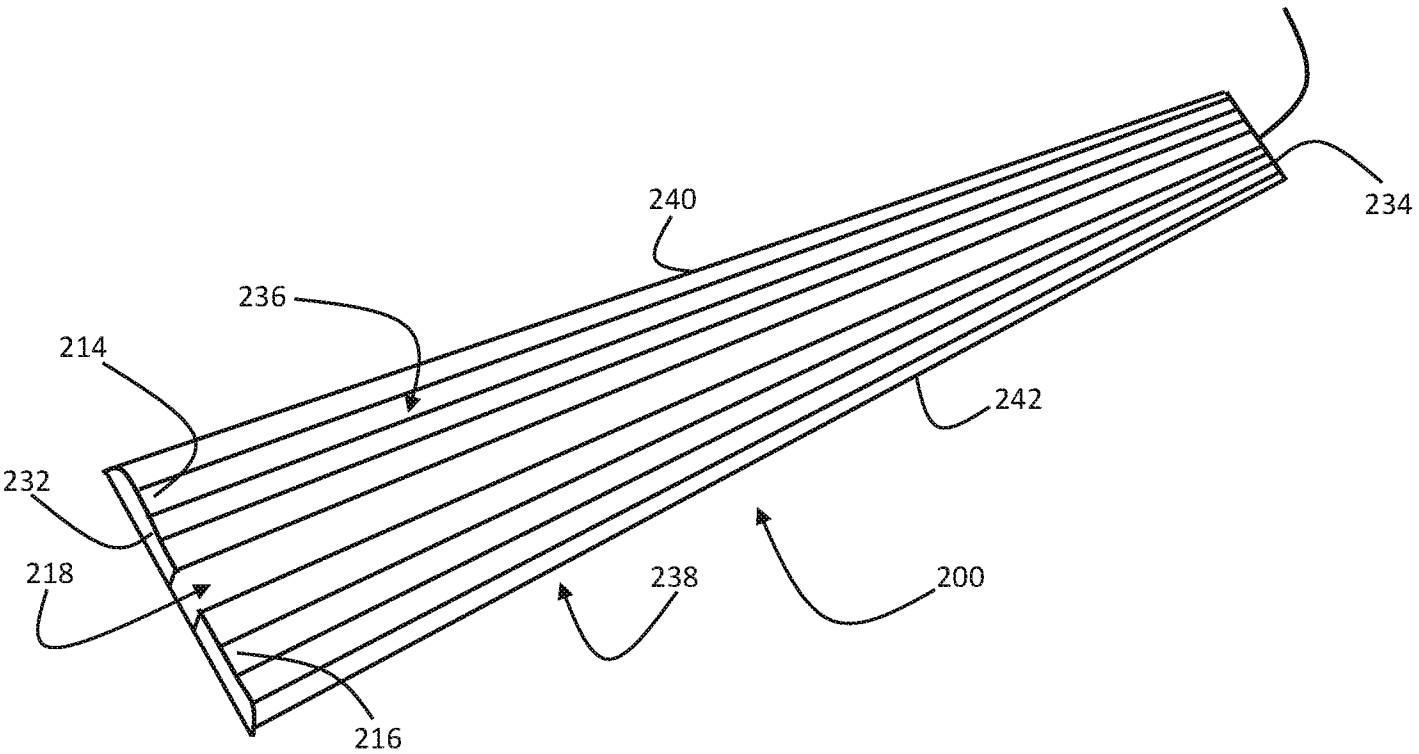

FIG. 3B depicts an illuminated base 200-2 that may generally rest on top of bottom 106 in display channel 100 to effectively form the upper surface of the bottom of channel 100. Illuminated base 200-2 may include a front 232, a back 234, a top 236, a bottom 238, a left side 240 and a right side 242. Base 200-2 may be of similar size and shape as bottom 106, and may include any other elements or characteristics that may be required for illuminated base 200-2 to generally and securely rest on top of bottom 106 when configured within channel 100 as the top surface of the bottom of the channel 100. Base 200-2 may comprise metal, plastic, rubber or other types of materials and any combination thereof.

For example, illuminated base 200-2 may include a width that may be received within channel 100 so that illuminated base 200-2 may generally rest on top of the bottom 106 within channel 100, and a length that may generally extend from the front 102 of channel 100 to the back 104 of channel 100 or a portion thereof. It may be preferable that regardless of the architecture of channel 100 and bottom 106, illuminated base 200-2 may be configured within channel 100 to generally and securely rest on top of bottom 106 to effectively form the bottom of channel 100.

In practice, by resting on top of bottom 106 thereby generally forming the top surface of the bottom of channel 100, the top 236 of illuminated base 200-2 may receive and support various beverage containers that may be placed within channel 100. It may be preferable that base 200-2 be generally held secure within channel 100 so that it may not slide or generally move around within the channel 100.

It should be also noted that the illuminated base 200 may be manufactured directly with channel 100 such that illuminated base 200 may form the bottom of channel 100 upon deployment of channel 100 within the beverage display 12.

In the case where channel 100 may not include a bottom 106, and the top of the shelving 14 that channel 100 may be configured with may provide and effectively act as the bottom of the channel 100, the illumination base 200 may be configured to rest within the channel 100 on top of the shelving 14 to effectively provide an inner bottom to channel 100. For the purposes of this specification, the illumination base 200 that may rest on the shelf 14 within the channel 100 may be referred to as illumination bas 200-3.

Figure 3C:
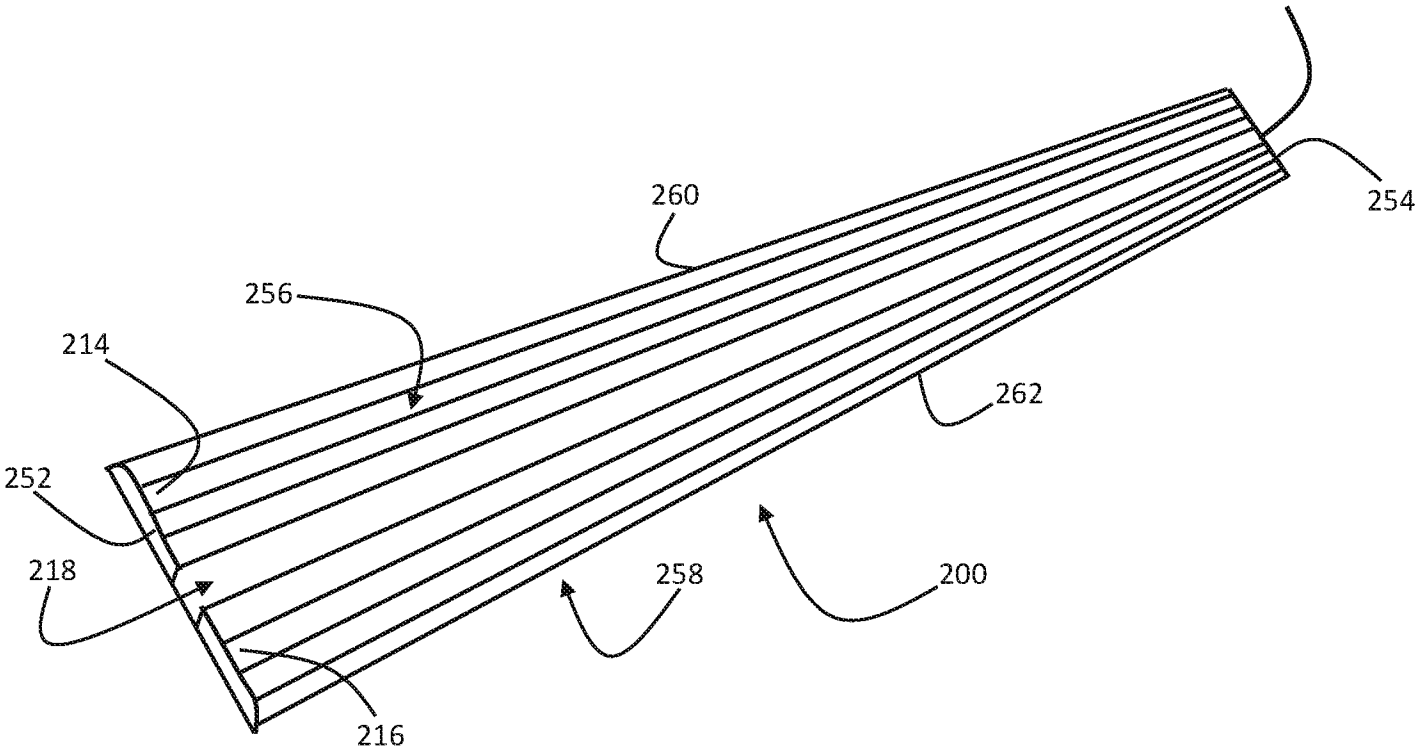

As shown in FIG. 3C, the illuminated base 200-3 may include a front 252, a back 254, a top 256, a bottom 258, a left side 260 and a right side 262. The outer circumference of base 200-3 may be of similar size and shape as the bottom open area within channel 100 such that it may generally fit within the open area on top of the shelving 14 within channel 100. Base 200-3 may include any other elements or characteristics that may be required for it to generally rest on top of the shelf 14 when configured within channel 100 as the top surface of the bottom of the channel 100. Base 200-3 may comprise metal, plastic, rubber, other types of materials and any combination thereof.

For example, illuminated base 200-3 may include a width that may be received within channel 100 so that illuminated base 200-3 may generally rest on top of the shelving 14 within channel 100, and a length that may generally extend from the front 102 of channel 100 to the back 104 of channel 100 or a portion thereof. It may be preferable that regardless of the architecture of channel 100, illuminated base 200-3 may be configured within channel 100 to generally and securely rest on the top of the shelving 14 within channel 100 that channel 100 may be configured with to effectively form the bottom of channel 100. It may be preferable that base 200-3 be generally held secure within channel 100 so that it may not slide or generally move around within the channel 100.

In practice, by resting on top of the shelf and within channel 100 to generally form the bottom of channel 100, the top 256 of illuminated base 200-3 may receive and support various beverage containers that may be placed within channel 100.

Note that an illumination base 200 may also be configured with a shelf 14 within the display unit 12 without a channel 100. In this embodiment, the illumination base 200 may be configured with the shelf 14 (e.g., may rest upon the shelf 14) such that the beverage containers may rest on the top surface of the illumination base 200. For example, multiple illumination bases 200 may be configured generally side by side on a shelf 14, extending from the front of the shelf 14 to the rear of the shelf 14. In this way, beverage containers may be placed on the side by side rows of illumination bases 200 to form side by side rows of beverage containers.

It is understood by a person of ordinary skill in the art that the illumination base 200 may be configured within the display unit 12 in any way such that it may support the lighting assembly 300 to illuminate the beverage containers, and that the scope of the system 10 is not limited in any way by the way in which the illumination base 200 may be configured within the display 12.

Figure 4:
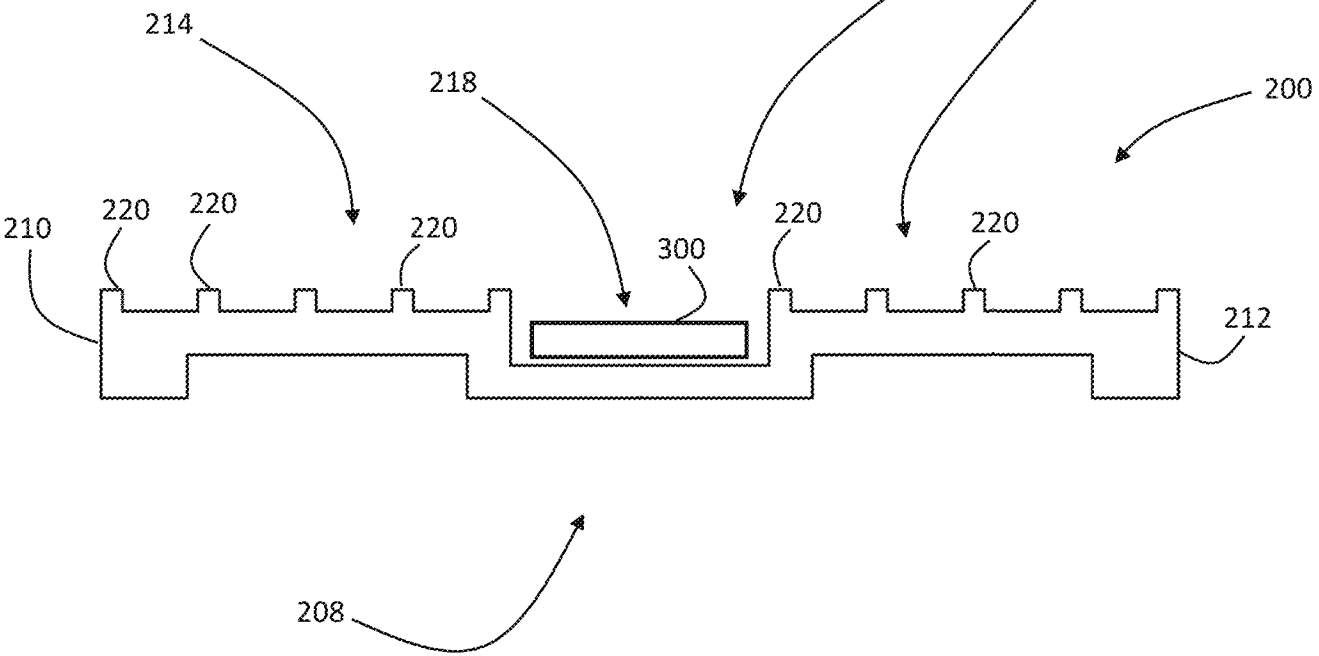
FIG. 4 is a front view of a base according to exemplary embodiments hereof.

Turning now to FIG. 4, the cross-section of base 200 from the perspective of looking directly into the front 202 of base 200 is depicted. The top 206 of base 200 may include a left raised portion 214, a right raised portion 216 and an inner recessed channel 218. As shown, the inner recessed channel 218 may be located between the left and right raised portions 214, 216. As described in other sections, the inner recessed channel 218 may be configured to receive and support the lighting assembly 300. It may be preferable that the left and right raised portions 214, 216 be generally the same or similar height and width such that the cross-section of base 200 may be generally symmetrical about the center point. However, this may not be required.

Left and right raised portions 214, 216 may also include top raised rails 220 (also referred to as crown rails 220) that may extend from the tops of raised portions 214, 216. The top raised rails 220 may have a generally narrow width (e.g. 1 mm, 2 mm, 3 mm, 4 mm or other widths) and may generally extend from the front 202 to the back 204 of the base. Raised rails 220 may generally run parallel to each other. However, it should be noted that raised rails 220 may also include other patterns of rails 220 and may run in other orientations such as diagonally, crisscross, sideways, curved or in other patterns or orientations. As shown, the raised rails 220 may be separated from each other by a small distance (e.g. 3.5 mm, 5 mm, 1 cm or other distances) and each raised portion 214, 216 may include one, two, three or more raised rails 220.

There are several purposes of raised rails 220. First, as described above, beverage containers will rest on the top 206 of base 200, and with top 206 including raised rails 220, it can be seen that the tops of raised rails 220 may define the upper most top of base 200 that the beverage containers may rest upon. Given this, because the tops of raised rails 220 may be generally narrow, they may include less top surface area that may be in contact with the bottom of the beverage containers compared to if the beverage containers were resting on a flat surface. The amount of surface area in contact with the bottom of the beverage containers defines the amount of friction between the beverage containers and the surface area, so by reducing the amount of surface area in contact with the bottoms of the beverage containers, raised rails 220 may reduce the amount of friction between the beverage containers and base 200. This may be important to more easily allow the beverage containers to slide forward within channel 200 when customers remove beverages in the front of the channels 200.

Another benefit of crown rails 220 may be that they may allow for liquid, dirt or other debris or substances that may be spilled onto the top of base 200 to settle into the recesses between raised rails 220 and therefore away from the bottoms of the beverage containers. In this way, the bottoms of the beverage containers may be kept generally clean and free of possible contamination. The spilled liquid or other substances may be generally contained in the in-between recesses and may be flushed out or otherwise cleaned or removed from base 200 when necessary.

As shown, base 200 may also include inner recessed channel 218. Inner recessed channel 218 may be generally formed between left and right raised portions 214, 216 on the top 206 of base 200, and may generally extend from the front 202 to the back 204 of channel 200 generally parallel to the raised portions 214, 216. In this way inner recessed channel 218 may generally be located in the center of the cross-section of channel 200 as shown in FIG. 4. It is understood that the inner recessed channel 218 may run continuously from the front of the base 200 to the rear of the base (or any portion thereof), or, alternatively, that the inner recessed channel 218 may include segments that may be longitudinally aligned so that the aggregate segments may generally extend from the front of the base 200 to the rear of the base 200 (or a portion thereof). In this case, the inner recessed channel 218 may not be continuous from the front of the base 200 to the rear of the base 200.

In another exemplary embodiment hereof as shown in FIGS. 5A-5I, the illumination base 200 may comprise a lower base section 222 (FIG. 5A) and an upper base section 224 (e.g., various embodiments shown in FIGS. 5B-5E). The drawings shown in FIGS. 5A-5I are taken from the perspective of looking into the front of the lower base section 222 and/or the upper base section 224. It is understood that the lower base section 222 of FIG. 5A may be configured with any one of the upper base sections 224 shown in FIGS. 5B-5E to form the combined base sections 200 respectively shown in FIGS. 5F-5I. Once combined as shown in FIGS. 5F-5I, the lower base section 222 and the upper base section 224 may form an illumination base 200 that may include all of the elements and characteristics described above in relation to the illumination base 200.

The lower base section 222 may include an upper portion 226 and a lower portion 228. The upper portion 226 may be configured to receive the upper base section 224. In this way, the upper base section 224, when received and attached to the lower base section 222 may form the top portion of the illumination base 200. The lower portion 228 of the lower base section 222 may generally form the bottom of the illumination base 200.

The lower base section 222 may include the recessed channel 218 as described in other embodiments. The upper portion 226 may include top raised rails 220 (also referred to as crown rails 220) that may extend from its top surface on the left and right sides. It is understood that the top raised rails 220 in this embodiment may include all of the elements, characteristics and benefits of the top raised rails 220 as described in other embodiments herein.

In one exemplary embodiment hereof, the upper base section 224 may be attached and/or secured to the lower base section 222 by side clamps 229 on the left and right sides of the upper base section 224. As shown, the side clamps 229 may extend from the upper base section 224 down the left and right sides of the lower base section 222 and underneath a portion of the lower base section 222. In this way, the side clamps 229 may hold the left and right sides of the lower base section 222 and secure the upper base section 224 to the lower base section 222. It may be preferable that the lower base section 222 fit snugly within the side clamps 228 so that the sections 222, 224 are securely attached together.

Note that the upper base section 224 may be attached to and/or be secured to the lower base section 222 by other attachment methods, and the scope of the system 10 of the illumination base 200 is not limited by the methods used to attach and/or secure the upper base section 224 and the lower base section 222 together. For example, as shown in FIG. 5F, the lower base section 222 may include attachment mechanisms 230 (e.g., upper notches) that may be configured with lower clips 234 (best seen in FIGS. 5B and 5F) on the upper base section 224 to secure the sections 222, 224 together. Other attachment methods may include using adhesive, using friction, using screws, using nuts and bolts, using double-sided tape, using other types of attachment mechanisms and any combination thereof. Once combined as shown in FIGS. 5F-5I, the lower base section 222 and the upper base section 224 may form an illumination base 200 that may include all of the elements and characteristics described above in relation to the illumination base 200.

Prior to attaching the upper base section 224 with the lower base section 222, or once the upper base section 224 may be configured with the lower base section 222, it may be preferable to remove at least a portion of the center section 236 of the upper base section 224 that may be generally positioned above the inner recess 218 and that may extend parallel to it. As will be described in later sections, the inner recess 218 may be configured with the lighting assembly 300 that may shine light upward from the inner recess 218. By removing the center section 236 of the upper base section 224, the light emitted by the lighting assembly 300 may not be obstructed by the upper base section 224. It is understood that all or only a portion of the center section 236 of the upper base section 224 may be removed.

The center section 236 of the upper base section 224 may be removed by cutting the center section out, by boring the center section out, by routing the center section out, by cutting the upper base section 224 or by other removal techniques.

In another exemplary embodiment hereof, the center section of the upper base section 224 may be transparent, opaque, may include slots, holes, other apertures or may otherwise allow the light emitted by the lighting assembly 300 to pass through the upper base section 224 and be directed upward from the illumination base 200. In this way, the center section of the upper base section 224 may or may not be required to be removed. This may provide a cover to the lighting assembly 300 that may be configured within the recess channel 218. It is understood that one or more portions of the center section 236 may be removed and that one or more portions of the center section 236 may be transparent, opaque and/or include slots, holes or other apertures to allow light to pass from the lighting assembly 300 through the upper base section 224.

One benefit of the multi-section illumination base 200 may be that the upper base section 224 may be formed using a different material than the lower base section 222. For example, the lower base section 222 may be formed of a strong material such as aluminum that may provide the strength, rigidity, and support required for its application. However, aluminum may not be smooth enough to allow the bottom of the beverage containers to easily slide upon its top surface as required and as described above. In this case, the upper base section 224 may be formed of a material that may be smoother than the lower base section aluminum, may have less friction, and may allow the beverage containers to more easily slide upon its top surface. In this way, the overall base section 200 may be strong due to the aluminum lower base section 222, and may include a smooth and low-friction upper surface due to the upper base section 224.

In one preferred implementation, the upper base section 224 may be formed by extruding high impact polystyrene (HIPS) mixed with silicon resin during the extrusion process. Note that the lower base section 222 and the upper base section 224 may be formed of any other materials and/or any combinations of materials using any type of forming processes.

The Lighting Assembly

In one exemplary embodiment hereof, the inner channel 218 of the base 200 may be generally configured to receive and support the lighting assembly 300 as shown in FIGS. 4, 5A, 6 and 7. In one exemplary embodiment hereof, the lighting assembly 300 may include an LED strip 302 with LED elements 304 that when configured within inner recessed channel 218 may emit light upward into the bottoms of the beverage containers that may be resting on the top 206 of lighted base 200. This will be described in greater detail in sections below. It is understood by a person of ordinary skill in the art that the lighting assembly 300 may include any types of illumination devices such as incandescent lighting devices, neon lighting devices, fluorescent lighting devices, laser lighting devices, other types of lighting devices and any combination thereof.

In one exemplary embodiment, the LED strip 302 may be a thin flexible strip that may include one or more LED elements 304 that may emit light generally upward from LED strip 302. LED strip 302 may comprise one or more strip segments that may each include one or more LED elements 304 that may be configured together to generally form LED strip 302. Alternatively, LED strip 302 may be formed as one complete segment. In any event, once formed, elements 304 may be located or generally positioned periodically along the length of LED strip 302 from the front 304 to the back 306 of LED strip 302. It may also be preferable that LED strip 302, elements 304 and any other components included with or associated with LED strip 302 be generally waterproof. However, this may not be required and LED strip 302 may be enclosed in a waterproof casing, cover or encasing that may or may not a part of base 200. It may also be preferable for LED strip 302 and LED elements 302 to have one or more of the following certifications: CE, ROHS, UL Component Recognized, UL Listed and other types of certifications.

As seen in FIG. 4, the depth and width of inner recessed channel 218 may be such that LED strip 302 may be received to generally rest within channel 218. That is, the width of LED strip 302 may be slightly less than the width of inner recessed channel 218. For example, the width of LED strip 302 may be 50 mm and the width if recessed channel 218 may be slight larger than 50 mm (e.g. 60 mm or other widths) in order to receive and generally accommodate LED strip 302. In addition, the length of LED strip 302 may generally correlate with the full length or a portion of the length of the inner channel 218 of base 200. It may be preferable that the front 304 of LED strip 302 be generally aligned with the front 202 of base 200, and that the back 306 of LED strip 302 be generally aligned with the back 204 of base 200. In this way, LED strip 302 may generally run along the length of base 200 within recess 218. However, this may not be required.

In addition, it may be preferable that the depth of recessed channel 218 allow for LED strip 302 to rest within the channel 218 with the top of the LED strip below the top surfaces of the raised rails 220 such that the bottom of the beverage containers that may be resting on the rails 220 may not come into physical contact with LED strip 302. For example, the height of LED strip 302 may be 5 mm and the depth of recessed channel 218 may be 10 mm or other depths to accommodate LED strip 302. Note however, there may be cases where the top of LED strip 302 may extend upward to be generally flush with or raised above the tops of raised rails 220 such that it may come into physical contact with the bottoms of the beverage containers resting on base 200.

LED strip 302 may be secured within inner recessed channel using adhesive, double-sided tape, pressure fit, screws, clamps, clips, may be held by gravity or by other securing means or mechanisms.

The spacing between LED chips 304 may be symmetrical such that LED chips 304 may be evenly spaced along the length of LED strip 302, or may be such that the chips 304 are not evenly spaced. For example, LEDs 304 may be spaced 5 cm apart from one another. Other spacings may also be used. In any event, it may be preferable that the spacing of the LED chips 304 be such that the chips 304 may be in close proximity to the bottoms of the beverage containers resting on base 200. It may be preferable that at least one LED element 304 along LED strip 302 be positioned to emit light upward into each beverage container that may be resting on base 200. However, this may not be required for each and every beverage container.

In this way LED elements 304 may emit light into the bottoms of the beverage containers that may be resting on the top 206 of base 200. LED chips 304 may include white light, single color, RGB or other types of colored, non-colored or any combination of different types of LEDs 304 thereof. Accordingly, LED strip 302 may generally emit any desired type or color of light into the bottoms of the beverage containers. It may also be preferable that the output intensity of the LED elements 304 be high enough that the light emitted upward into the bottoms of the beverage containers may penetrate the beverage containers, may pass through the liquid that may be inside the containers and may permeate out the top and sides of the beverage container to be viewed by the potential customers. In other words, it may be preferable that the intensity of the output of the LED elements 304 be such that the emitted light passing through and out of the beverage containers be clearly visible to customers who may be viewing the beverage containers resting within the display units during broad daylight. Accordingly, it may be preferable that the light permeating out of the beverage containers from the LED elements 304 be of higher intensity than the ambient light within the display unit or within the storefront. In addition, this may be preferable regardless if the light is white light, single colored light, multi-colored light (such as RGB) or any other type of light. It should also be noted that different LED elements 304 may be capable of different intensities of emitted light, such that one or more LED elements 304 may emit light that may be of higher intensity or of lower intensity compared to other LED elements 304. It may also be preferable that the color and intensity of at least a portion of the LED elements 304 be variable and controllable as such. An example of an illuminated base 200 configured with a LED strip 302 configured to illuminate beverage containers that may be placed upon the base 200 is depicted in FIG. 6. Note that other elements of the channel 100 such as the front, back and sides may not be illustrated in this figure.

Note that LED strip 302 and LED elements 304 may be off-the-shelf such that they may be purchased from a manufacturer or general supplier of LED strips 302. Alternatively, LED strip 302 and LED elements 304 may be specifically designed and manufactured for use with illumination system 10. In any case, LED strip 302 with LED chips 304 may be configured with base 200 to adequately operate as described above.

In addition, LED strip 302 may include any other electrical or non-electrical components that may be required for LED strip 302 and LED elements 304 to operate as described. For example, LED strip 302 may include resistors, inductors, capacitors, sensors, impedance matching networks, power transformers (e.g. an AC to 12 v converter), power cord/jack to be plugged into a power outlet and any other type of components or mechanisms that may be required to generally power, control, maintain and generally operate LED strip as described above. Note that LED strip 302 may be plugged into a power outlet to receive power and/or may be battery powered and if so may include standard or rechargeable battery packs, or a combination thereof, to provide the necessary power to LED elements 304 as required. It may be preferable that these components be waterproof but this may not be required. The LED strip 302 may also be configured with the power supply and/or network of the display case that it may be configured with.

It is understood by a person of ordinary skill in the art, upon reading this specification, that the lighting assembly 300 configured with the illumination base 200 may be installed in a beverage display unit 12 prior to the deployment of the display unit 12 into the marketplace (e.g., during the manufacturing process of the display unit 12). It is also understood that the lighting assembly 300 configured with the illumination base 200 may be configured with (e.g., retrofitted with) a display unit 12 that may already be manufactured and may either be deployed in the marketplace or ready to be deployed into the marketplace. That is, some exemplary embodiments of the system 10 may include a display unit 12 configured with the lighting assembly and illumination base 200 combination, and some embodiments of the system 10 may include a lighting assembly 300 configured with an illumination base 200 that may be installed or otherwise configured with an existing display unit 12.

As depicted in FIG. 6, illumination system 10 may also include controller 400. Controller 400 may comprise any type of controller that may generally control the operation of lighting assembly 300 including LED strip 302 and at least a portion of LED elements 304. Controller 400 may comprise a computer, a CPU, a microprocessor, a microcontroller, a control board or any other type of controller 400 and/or other components necessary for controller 400 to generally operate. Controller 400 may also include software or the other types of command scripts or applications that may be stored within controller 400 in any way necessary and used to generally control and operate system 10. In this way, controller 400 may be generally programmed to control the various elements 304 of LED strip 302 as desired.

For example, controller 400 may be configured with LED strip 302 and LED chips 304 to control in real time the color of the emitted light by each LED 304. Each LED 304 may have the ability to emit light of different or varying colors and controller 400 may be programmed to vary the emitted colors in an orchestrated sequence. For instance, for a Fourth of July bottled water promotion within a beverage display for a particular brand, controller 400 may be programmed to control LEDs 304 to perform a choreographed sequence of red, white and blue alternating lights. The LEDs 304 along the length of LED strip 302 may emit light in alternating red, white and blue colors, blinking the different colors or fading and blending the different colors in and out, such that the bottled water bottles held within channel 100 may appear to be blinking or fading in and out red, white and blue colors in different patterns along the length of LED strip 302. The intensities of the different LEDs 304 may also be varied or otherwise controlled by controller 400 such that the LEDs 304 may dim and then become brighter while also changing colors.

It can be immediately seen that this choreographed light show of bottled water containers within a beverage display may immediately draw attention to the particular brand of water that may be a part of the promotion and may result in increased attention and sales of the products.

It is understood by a person of ordinary skill in the art that the above example is meant only for demonstration purposes and that the invention is not limited in any way by this example. It can be recognized that controller 400 may control LEDs 304 in a multitude of different ways to perform a near infinite number of different types of choreographed sequences of light, colors, intensities, patterns and other elements of the display. Other examples may include waves of different colors moving up and down the channel of LEDs 304 and beverage containers. Or sports drinks that may be on sale may blink a bright color that may seem to animate the bottle or bring it to life with glowing energy compared to other sports drinks that may not be illuminated.

Note also that controller 400 may have the ability to control the LEDs 304 in a random sequence such that they may blink, fade or otherwise be varied randomly and not necessarily in a predetermined choreographed sequence.

In addition, with one or more channels 100 aligned next to each other on a shelf within the beverage display, it can be seen that the side-by-side channels of beverage containers may generally form a matrix of containers. And, with each channel including lighting assembly 300 that may include an LED strip 302 with LED elements 304, there may also be formed a matrix of LED elements 304 generally under the matrix of beverage containers. In this way, each beverage container within the matrix of containers may be illuminated by the LEDs 304 as a pixel. It should be noted that controller 400 may be configured with one or more LED strips 302 and LED elements 304 within one or more channels 100 such that it may generally control each LED strip 302 and/or each LED element 304 within the matrix of LED elements 304. Accordingly, controller 400 may control the color, intensity and other characteristics of LEDs 304 within the matrix such that different shapes comprising different illuminated beverage containers may be formed. That is, controller 400 may illuminate particular LED elements 304 each a particular color or intensity such that the resulting illuminated beverage containers may form a shape of illuminated containers within the matrix.

For example, LEDs 304 that may represent a shape of a particular letter, or symbol (e.g. a happy face) may be illuminated such that the bottles resting within the side-by-side channels within the matrix of LEDs 304 may also be illuminated to form the letter or shape. The controller 400 may also cause the shape to change or transition into different letters by controlling the particular LEDs 304 that may represent each desired shape or letter to fade in and out.

Note that the above example is meant only for demonstration purposes and that the invention is not limited in any way by this example. It can be recognized that controller 400 may control LEDs 304 in a multitude of different ways to perform a near infinite number of different types of choreographed sequences.

For beverage containers that may be opaque and that may not generally allow light to permeate through the bottom of the containers and out the tops or sides, illumination system 10 may be configured generally above the rows of containers such that the LED strips 302 and LED elements 304 may illuminate the containers from above. In this configuration, the base 200 configured with lighting assembly 300 may be generally configured to the underside of the shelf above the beverage containers such that the LED elements 304 may be generally facing downward onto the beverage containers from above. Note that all of the elements of system 10 as described with respect to the other examples and embodiments described above may also pertain to this embodiment.

The system 10 may also include sensors that may sense a variety of conditions. In one exemplary embodiment, the system 10 may include motion detectors that may detect the presence of a customer, and upon this sensing, may alert the controller 400 to begin an orchestrated light show utilizing the system 10. In other exemplary embodiments, the sensors may include beverage container sensors that may sense when a beverage container may be dislodged or otherwise not placed correctly on the system 10. Other exemplary embodiments may include sensors that may detect the presence of a beverage container at a particular location on the illumination base 200 and/or the lighting assembly 300, and once detected, may alert the controller 400 to illuminate that portion of the lighting assembly 300 in order to illuminate the sensed beverage container. Other types of sensors may also be implemented.

Regarding other types of displays such as behind-the-bar displays that may comprise shelves, racks or other types of displays, it can be seen that illuminated base 200 configured with lighting assembly 300 may be placed underneath beverage containers that may be displayed in these other types of displays such that LED strips 302 and LED elements 304 may be configured generally beneath the beverage containers to illuminate the containers as described above in the other examples and embodiments. Note that all of the elements of system 10 as described with respect to the other examples and embodiments described above may also pertain to this embodiment. In addition, all of the elements according to the embodiment pertaining to base 200 and lighting assembly 300 configured to illuminate the beverage containers from above may also apply to this example.

In addition, system 10 may include speakers and controller 400 may include the ability to play music or other audio or audible sounds. In this way, the LEDs 304 may be controlled to flash, dim or otherwise be varied in a way that may follow the beat, rhythm or melody of the music or other audio sounds accordingly.

Although certain presently preferred embodiments of the invention have been described herein, it will be apparent to those skilled in the art to which the invention pertains that variations and modifications of the described embodiments may be made without departing from the spirit and scope of the invention.

What is claimed is:

1. An illumination system, the system comprising:
a base for supporting at least one container; and
an illumination device configured within the base;
wherein the base supports the at least one container and the illumination device illuminates the at least one container.

2. The illumination system of claim 1 further comprising a channel configured within the base and that supports the illumination device.

3. The illumination system of claim 2 wherein the at least one container rests on an upper surface of the base and the channel is configured below the upper surface of the base.

4. The illumination system of claim 3 wherein the channel includes a recess and the illumination device is configured within the recess to illuminate the at least one container from beneath the at least one container.

5. The illumination system of claim 2 wherein the channel extends from the front of the base to the rear of the base.

6. The illumination system of claim 1 wherein the base includes an upper base section and a lower base section that when configured together form the base.

7. The illumination system of claim 6 wherein the lower base section includes a channel that supports the illumination device.

8. The illumination system of claim 7 wherein the at least one container rests on an upper surface of the upper base section and the channel is configured below the upper surface of the upper base section.

9. The illumination system of claim 8 wherein the channel includes a recess and the illumination device is configured within the recess to illuminate the at least one container from beneath the at least one container.

10. The illumination system of claim 7 wherein the channel extends from the front of the lower base section to the rear of the lower base section.

11. The illumination system of claim 1 wherein the illumination device includes an LED strip.

12. The illumination system of claim 11 wherein the LED strip includes LEDs that emit colors of light selected from red, green, blue and white.

13. The illumination system of claim 1 further comprising a controller.

14. The illumination system of claim 13 wherein the controller controls the lighting of the illumination device.

15. The illumination system of claim 1 wherein the containers are beverage containers.

16. The illumination system of claim 1 wherein the base is configured within a beverage display.

17. The illumination system of claim 16 wherein the beverage display includes at least one shelf to support beverage containers and the base is configured with the at least one shelf.

18. The illumination system of claim 16 wherein the beverage display includes at least one channel to support beverage containers and the base is configured with the at least one channel.

19. An illumination system, the system comprising:

a base for supporting two or more beverage containers positioned in a row along the base; and an illumination device configured within the base;

wherein the base supports the two or more beverage containers and the illumination device illuminates the two or more beverage containers.

20. The illumination system of claim 19 wherein the base is configured within a refrigerated beverage display.

* * * * *